United States Patent [19]

Raasch et al.

[11] 4,276,742

[45] Jul. 7, 1981

[54] THREAD-JOINING DEVICE

[75] Inventors: Hans Raasch; Hans Grecksch, both of Monchen-Gladbach, Fed. Rep. of Germany

[73] Assignee: W. Schlafhorst and Co., Monchen-Gladbach, Fed. Rep. of Germany

[21] Appl. No.: 79,545

[22] Filed: Sep. 27, 1979

Related U.S. Application Data

[63] Continuation of Ser. No. 885,563, Mar. 13, 1978, abandoned.

[30] Foreign Application Priority Data

Mar. 17, 1977 [DE] Fed. Rep. of Germany ..... 2711554

[51] Int. Cl.[3] ..... D01H 15/02

[52] U.S. Cl. ..... 57/263; 242/35.6 R

[58] Field of Search ..... 57/58.89–58.95, 57/261, 263; 242/35.6 R, 35.6 E, 37 A

[56] References Cited

U.S. PATENT DOCUMENTS

| | | | |
|---|---|---|---|
| 3,354,631 | 11/1967 | Elias et al. | 57/58.95 |
| 3,695,017 | 10/1972 | Hori et al. | 57/263 |
| 3,810,352 | 5/1974 | Miyazaki et al. | 57/263 |
| 4,041,684 | 8/1977 | Kamp | 57/263 |
| 4,083,171 | 4/1978 | Konig et al. | 57/263 |

*Primary Examiner*—John Petrakes

*Attorney, Agent, or Firm*—Herbert L. Lerner

[57] ABSTRACT

A joining device for joining a thread returned from a take-up coil to a spinning rotor of a rotor spinning machine by a thread regulator, the thread regulator having a thread clamp includes a roller pair, at least one of the rollers of the roller pair being drivable in direction in which the thread is returned.

1 Claim, 3 Drawing Figures

THREAD-JOINING DEVICE

This is a continuation of application Ser. No. 885,563, filed Mar. 13, 1978, now abandoned.

The invention relates to a thread-joining or piecing device for joining a thread returned from the take-up coil of the spinning rotor of a rotor spinning machine by means of a thread regulator having a thread clamp.

For automatically eliminating a thread break in a rotor spinning machine, the thread-joining device must draw off the thread end that has already run up on the take-up coil and return it to the delivery of draw-off tube of the spinning rotor. For this purpose, a thread regulator or feeder has been proposed heretofore which grips the thread by means of a thread clamp and brings it in front of the mouth of the delivery tube of the spinning rotor. There, the thread clamp opens and the thread end is to be sucked into the spinning chamber by the suction air drawn into the delivery tube.

Since undesired air is sucked in through the delivery tube during the spinning operation, the cross section of the delivery tube is sought to be kept as small as possible. This, on the other hand, makes the automatic return of the thread end into the spinning chamber more difficult.

To facilitate the introduction of the thread into the delivery tube, it has been suggested that the thread end be blown into the mouth of the delivery tube by means of compressed air. However, the amount and the direction of the compressed air must be determined accurately, so that no vortices or eddies occur due to which the thread end can be hurled out of the mouth again.

Fine, greatly twisted threads have the tendency to form curls in slack condition. When the thread clamp of the thread feeder or regulator is opened, the thread becomes almost tension-free and curls may form, thereby preventing reliable return of the thread to the spinning rotor.

It is an object of the invention to provide a thread-joining device which avoids the foregoing disadvantages of heretofore known thread-joining devices of this general type and to make possible a reliable return of the thread to the spinning rotor and, consequently reliable thread-joining.

With the foregoing and other objects in view, there is provided, in accordance with the invention, in a joining device for joining a thread returned from a take-up coil to a spinning rotor of a rotor spinning machine by a thread regulator, the thread regulator having a thread clamp comprising a roller pair, at least one of the rollers of the roller pair being drivable in direction in which the thread is returned. This pair of rollers takes over the return of the thread forcibly until the thread is seized and held reliably by the suction air drawn into the delivery tube of the spinning chamber.

The advantages attained with the invention are especially that, at the instant the thread clamp is released, the thread is already sucked up reliably by the suction tube of the spinning chamber and retains its tension after the thread clamp has been released and therefore cannot contribute to any disturbance of the thread-joining process by loss of the thread tension or formation of curls.

Other features which are considered as characteristic for the invention are set forth in the appended claims.

Although the invention is illustrated and described herein as embodied in a thread-joining device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
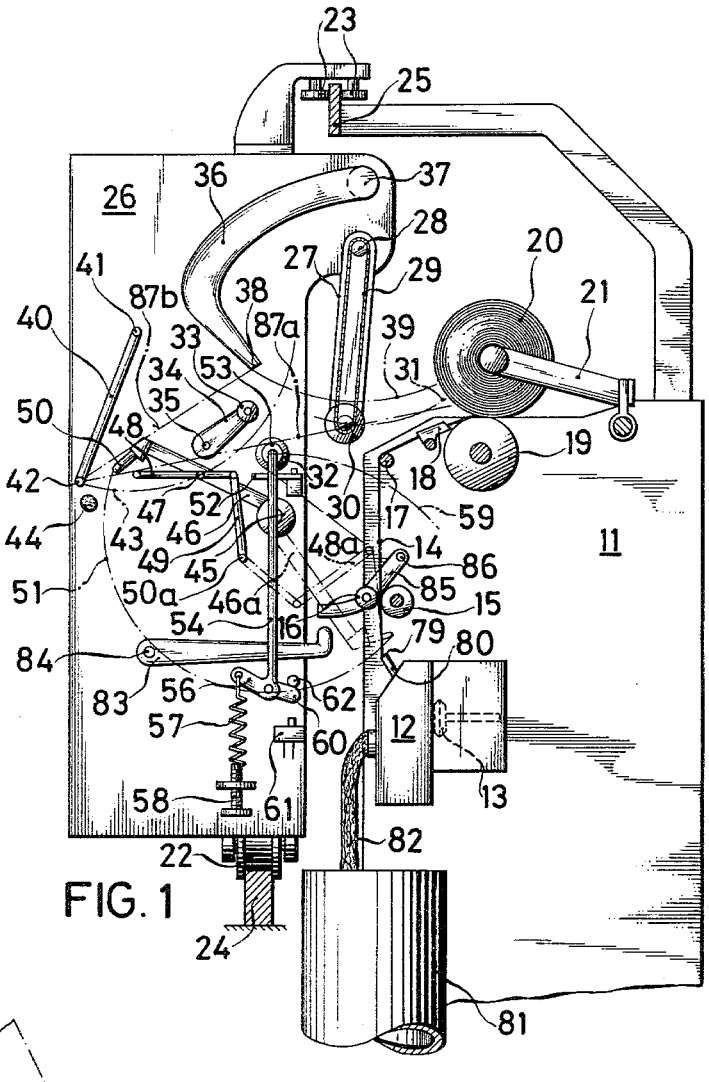
FIG. 1 is a diagrammatic side elevational view of a thread-joining device and a spinning station of a rotor spinning machine.

Referring now to the drawing and, first, particularly to FIG. 1, there is shown a spinning station 11 having a rotor spinning device 12 with a spinning rotor 13.

In normal operation, a spun thread 14 is conducted through a thread draw-off device formed of a draw-off roller 15 and a clamping roller 16. The thread 14 is withdrawn from the rotor spinning device 12 at constant speed by the thread draw-off device 15, 16. From the draw-off roller 15, the thread 14 runs over a deflection bar 17, through a thread guide 18 and over a winding cylinder 19 into a take-up coil 20. The take-up coil 20 is driven by the winding cylinder 19 by friction with constant peripheral velocity. The take-up coil 20 is supported in a coil frame 21.

In front of the spinning station 11, a thread-joining or piecing device 26 can be seen, which can travel on tracks 24 and 25 by means of rollers 22 and 23. The thread-joining device 26 has a drive arm 27 which is rotatable about a swivel joint 28. A drive roller 30, which is drivable by a chain drive 29 and is rotatably supported at the end of the drive arm 27, is pivotable along a circular arc 31. The drive roller 30 is drivable in both rotary directions by the chain drive 29.

At the thread-joining device 26, there can further be seen another thread draw-off or unwinding device made up of a draw-off roller 32 and a clamping roller 33. The clamping roller 33 is mounted at the end of a lever 34 which is pivotable about a pivot 35. The drive roller 30 and the draw-off roller 32 are drivable synchronously at the same peripheral velocity.

A suction tube 36 is rotatably suspended at an articulating point 37, so that a suction nozzle 38 thereof is pivotable along a circular arc 39. A thread drawer 40 is pivotable about a pivot 41. A thread gripper 42 thereof describes a circular arc 43 when the thread drawer 40 is swung.

A grinding disc 44 serves for treatment of the thread that is to be returned, as described hereinafter in greater detail. Also seen are a thread feeder or regulator 46 pivotable about a swivel joint 45 and having a thread lifter 48 rotatably fastened thereto at a pivot 47. The thread lifter 48 is controllable by an articulatingly fastened link or couple 49. At the pivot **52*a*, the couple 49 is articulatingly connected to the housing of the thread-joining device 26. The thread clamp 50 of the thread feeder or regulator 46 is pivotable along a circular arc 51. The thread clamp 50 is constructed as a roller pair. Further details of the thread clamp 50** will be discussed hereinafter.

Below the draw-off cylinder 32, a throw-off device 52 is shown which is movable perpendicularly to the plane of the drawing of FIG. 1. The purpose of the throw-off device 52 is, at a given time, to throw a thread which is on the draw-off cylinder 32 onto the roller 53 of a thread transfer device 54. The thread transfer device 54 is pivotable about a pivot 55 and has a lever 56, from which one end of a return spring 57 is suspended. The other end of the return spring 57 is articulatingly fastened to an adjusting or set screw 58. By means of the adjusting screw 58, the spring force can be set. The roller 53 of the thread transfer device 54 is pivotable along the circular arc 59. When the thread transfer device 54 swings into the other end position thereof, the effective lever arm of the lever 56 varies, so that the effect of the return spring 57 on the thread transfer device 54 becomes less. The instant the thread transfer device 54 reaches the other end position thereof, the other lever 60 thereof actuates a switch 61.

A stop pin 62 prevents the thread transfer device 54 from swinging back unduly far under the action of the return spring 57. The swivel joint 55 is set at an angle, so that the roller 53 can swing under one end of the take-up coil 20.

Figure 2:
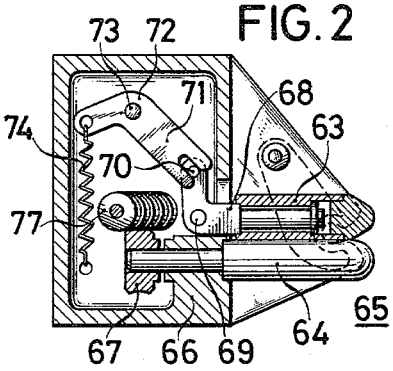
FIG. 2 is a much-enlarged fragmentary view of FIG. 1 partly in section.

FIG. 2 of the drawing is a cross-sectional view of the thread clamp 50 of the thread feeder or regulator 46. A roller pair 65 is shown formed of two rollers 63 and 64. The roller 64 is mounted in a bearing in a housing 66 of the thread clamp 50 and carries a worm gear 67 at the end thereof. The roller 63 is supported on a bellcrank or angle lever 68 which is pivotable about a pin 69. A pin 70 fastened to the bell crank 68 is engaged by a forked part 71 of a second bell crank or angle lever 72 which is mounted in the housing 66. This bell crank 72 is fastened to a shaft 73. The bell crank 72 is so spring-loaded by a tension spring 74 that the roller 63 is resiliently pressed against the roller 64. By turning the shaft 73, the roller 63 can be lifted away from the roll 64 and the clamping action of the thread clamp 50 can thereby be cancelled.

Figure 3:
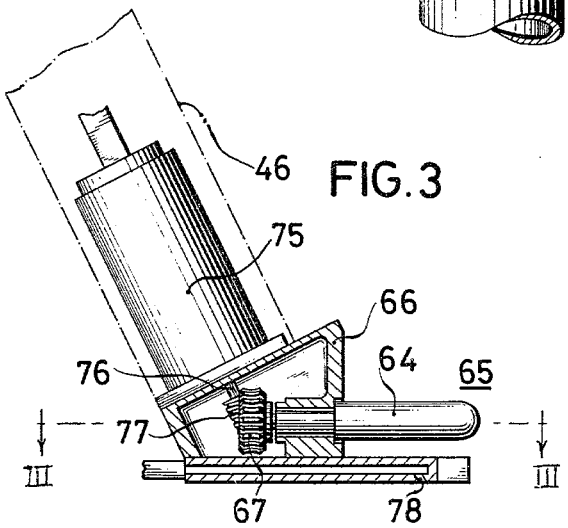
FIG. 3 is a view of FIG. 2 taken along the line III—III in direction of the arrows.

In FIG. 3 of the drawing, a cross-sectional view of the housing 66 is shown, which is perpendicular to the cross section shown in FIG. 2. It is noted in FIG. 3 that a geared motor 75 is flanged to the housing 66 from the outside. The shaft 76 of the geared motor 75 carries a worm 77 which meshes with the worm gear 67. The rotary speed of the geared motor 75 is variable so that the peripheral velocity of the roller 64 can be made to match the peripheral velocity of the draw-off roller 15. In FIG. 3, there is further seen a compressed-air nozzle 78 which is disposed below the roller pair 65 and, by means of which, introduction of the thread into a mount 79 of a delivery or draw-off tube 80 (FIG. 1) can be assisted.

FIG. 1 shows the disposition of all the parts in undisturbed spinning operation. Slubbing or sliver 82 from a can 81 is fed to the rotor spinning device 12. In the spinner rotor 13, the thread 14 is produced which is conducted through the delivery or draw-off tube 80 and is drawn off at constant speed by the draw-off device 15, 16. A lifter 83 which is pivotable at 84 and serves for lifting the clamping roller 16 which is fastened to a lever 85 and pivotable about a pivot 86, is in rest position thereof. In the event of an interruption of operation which required the thread to be joined again, an illustration corresponding to the view of FIG. 1 would depict the mode with the difference that the thread 14 would be missing and the thread end would have run up onto the take-up coil 20. Feed of the slubbing or sliver 82 would remain blocked.

Upon a starting command for thread-joining, the drive arm 27 swings toward the take-up coil 20. Thereafter, the suction arm 36 also starts to swing toward the take-up coil 20. The instant the drive arm 27 has reached the take-up coil 20, the drive roller 30 of the drive arm 27 starts to rotate in reverse. It lifts the take-up coil 20 off the winding cylinder 19 and rotates it in direction opposite the winding direction. At the same instant, the draw-off roller 32 is shifted ino reverse operation. The suction tube 36 approaches the take-up coil 20 so that the suction nozzle 38 is quite close to the surface of the coil 20. A search for the thread end is then made on the surface of the coil 20 and the thread end is sucked up by the suction nozzle 38. When this has occurred, the suction tube 36 swings back and entrains the thread 14. Simultaneously, the drive roller 30 and the draw-off roller 32 are inactivated. The draw-off roller 32 had so far had no contact with the thread and was running only because it is activated and inactivated synchronously with the drive roller 30.

The thread drawer 40 now swings upwardly, seizes the thread 14, swings back again and draws out a thread loop 87*a*, 87*b* represented by dot-dash lines. The thread then goes from the take-up coil 20 and between the clamping roller 33 and the draw-off roller 32 of the thread draw-off device to the thread gripper 42. From the latter, the thread end extends to within the suction nozzle 38. The clamping roller 33 is then swung toward the draw-off roller 15 and the thread feeder or regulator 46 is set in motion. Simultaneously, the clamping roller 16 is also lifted off the draw-off roller 15 by actuating the lifter 83. At this instant, the thread is clamped between the inactive draw-off roller 32 and the clamping roller 33. The thread draw-off device 15 and 16 of the spinning station is now fully opened. In the interim, the thread feeder 46 has been swung a short distance downwardly and, in fact, so far that the thread clamp 50, constructed as a roller pair is situated in front of the grinding wheel or disc 44. The grinding wheel 44 severs the thread and makes-ready a new thread end for joining by separating the fibers thereof and by forming a point thereon. The old thread end 87*b* is sucked by and removed by the suction nozzle 38.

The drive roller 30 and the draw-off roller 32 are then shifted into slow reverse operation. Simultaneously, the thread feeder or regulator 46 starts to swing further downwardly on the circular path 51. The thread clamp 50 of the thread regulator 46 opens as the roller 63 is lifted off the roller 64 by rotation of the shaft 73. The instant the part 87*a* of the thread loop is situated between the rollers of the thread clamp 50, the latter closes again and firmly holds the thread. At the end of the swinging motion, the thread feeder or regulator 46 assumes the position 46*a* thereof. The thread clamp 50 is then situated in front of the mouth 79 of the delivery or draw-off tube 80 of the rotor spinning device 12. Controlled by the couple or link 49, the thread lifter 48 has positioned itself in the interim transversely to the thread feeder or regulator 46 and has assumed the position 48*a* thereof, and has accordingly placed the thread part 87*a* into the opened thread draw-off device 15, 16 of the spinning station, as indicated by the dot-dash lines. The roller 64 of the thread clamp 50 is driven by the geared motor 75 in the thread return or unwinding direction, until the thread end is sucked into the delivery or draw-off tube 80. Then, the clamp 50 opens. At the same instant, the drive roller 30 and the draw-off roller 32 are shifted into a somewhat faster reverse gear operation.

The thread end has then almost reached the fiber collecting groove of the spinning rotor 13. The drive roller 30 and the draw-off roller 32 are briefly stopped in order immediately thereafter to feed back, in rapid reverse operation, a remaining thread length into the spinning rotor 13, whereby the joining per se occurs.

Then, the rotary direction of the drive roller 30 and of the draw-off roller 32 is reversed and subsequently increased, with accelerated high-speed, to a predetermined operating speed of the thread draw-off. Then, the thread feeder or regulator 46 starts to swing back.

The instant the thread feeder or regulator 46 has been swung back, the operating speed of the thread draw-off is also reached i.e. the draw-off rollers 15 and 32 have the same peripheral velocity. The draw-off roller 15 rotates continuously with normal thread draw-off velocity. The lifter 83 is taken back, so that the clamping roller 16 rests against the draw-off roller 15.

The thread can subsequently be transferred to the thread guide 18. To this end, the clamping roller 33 is lifted off the draw-off roller 32 initially and the throw-off device 52 is set into motion. The throw-off device 52 forces the thread laterally downwardly from the draw-off roller 32 so that it slides onto the roller 53 of the thread transfer device 54. When this has occurred, the thread transfer device 54 starts to swing inclined in direction toward the spinning station 11. Simultaneously, the drive roller 30 and the draw-off roller 32 are switched to fast forward operation. This is necessary so that, while the thread tension is unchanged or slightly increased, the take-up coil 20 can take up the additional thread length freed by the swing of the thread transfer device 54. The draw-off roller 32 then has no actual purpose any more, and therefore idles along because, in the interest of simplicity, it is operated synchronously with the drive roller 30. In the case at hand, the thread transfer device 54 is swung under the action of the thread tension against the force of the adjustable return spring 57. The return spring 57 is suspended so that the force component acting in the deflecting or excursion direction becomes smaller with increasing deflection or excursion of the thread transfer device 54. This is advantageous, because the wrapping angle of the thread and, accordingly, also the effective force component of the thread tension becomes smaller with increasing excursion or deflection. In the end position of the thread transfer device 54, the lever 60 actuates the switch 61. The switch 61 switches on the drive roller 30 and the draw-off roller 32 back to the normal thread draw-off velocity. Since the thread transfer device 54 deflects the thread at an inclination under a coil end of the take-up coil 20, it initially slides off laterally from the drive roller 30 and is seized by the thread guide 18 and drawn off laterally from the roller 53 of the thread transfer device 54.

After the thread transfer is completed, the thread transfer device 54 swings back again to the starting position thereof under the action of the return spring 57. When this has occurred, the drive arm 27 also starts to swing back. During the swinging motion of the drive arm 27, after the take-up coil 30 is disposed again on the winding cylinder 19, the drive roller 30 and the draw-off roller 32 are switched off or inactivated. As soon as the drive arm 27 has reached the rest position thereof according to FIG. 1, the control program is terminated and the entire thread-joining operation is completed.

The program control mechanism controlling the individual operations is contained in the thread-joining device 26 and is not shown in detail. A conventional electromechanical program control mechanism operating with cams can be employed, for example.

The invention is not limited to the embodiment shown and described herein. The geared motor 75 may be, for example, a d-c motor. With an appropriate choice of the voltage applied, the peripheral velocity of the roller 64 can be so adjusted, in this case, that it corresponds exactly to the peripheral velocity of the continuously rotating draw-off roller 15. The thread stretched between the two rollers 64 and 15 can then be neither unduly stressed nor loosened.

After the thread feeder or regulator 46 is swung into the thread transfer position thereof indicated by the dot-dash lines in FIG. 1 and after it has swung back into the starting position thereof, the shaft 73 can always be positioned so that it can be engaged and turned by a drive member of the automatic control mechanism contained in the housing of the thread-joining device 26.

Instead of the geared motor 75, a mechanical drive element can be provided as an alternative, and can be drive, for example, through linkages, shafts and gears and over the thread feeder or regulator 46, by the automatic control mechanism of the thread-joining device 26 synchronously with the draw-off roller 32.

There is claimed:

1. Automatic yarn piecing machine for joining a thread to be returned from a take-up coil to a spinning rotor of an open end spinning machine having a delivery tube and a pair of delivery rollers for delivering spun thread from the spinning rotor, comprising means disposed at an upper location of the automatic yarn piecing machine in the vicinity of the take-up coil for locating and sucking a thread end on the take-up coil, and thread regulator means for seizing the thread end from said locating and sucking means, said thread regulator means being movable from said upper location to a position below the pair of delivery rollers below said upper position at an end of the delivery tube, said thread regulator means having a thread clamp including a roller pair, and a motor for driving at least one of the rollers of said roller pair in direction in which the thread is returned.

* * * * *